United States Patent [19]

Johnson et al.

[11] Patent Number: 4,972,171

[45] Date of Patent: Nov. 20, 1990

[54] METHOD AND APPARATUS FOR DETECTING ILLEGAL PITCHES

[76] Inventors: Mark P. Johnson, 14620 NE. 32nd, Apt. F-5, Bellevue, Wash. 98007; Earl McCurdy, Rte. 1, Box, 444, Hensley, Ark. 72065

[21] Appl. No.: 379,092

[22] Filed: Jul. 13, 1989

[51] Int. Cl.[5] ..... A63B 71/02

[52] U.S. Cl. ..... 340/323 R; 250/221; 273/26 R

[58] Field of Search ..... 340/323 R; 273/26 R, 273/26 A, 25, 29 A, 181 H; 434/247; 364/411; 250/221, 222.1, 215

[56] References Cited

U.S. PATENT DOCUMENTS

| | | | |
|---|---|---|---|
| 4,039,932 | 8/1977 | Duckworth | 340/664 |
| 4,139,889 | 2/1979 | Ingels | 340/705 |
| 4,461,477 | 7/1984 | Stewart | 273/26 R |

FOREIGN PATENT DOCUMENTS

| | | | |
|---|---|---|---|
| 1565688 | 5/1969 | France | 273/25 |

*Primary Examiner*—Joseph A. Orsino
*Assistant Examiner*—Brent A. Swarthout
*Attorney, Agent, or Firm*—Hughes & Multer

[57] ABSTRACT

Methods of and apparatus for detecting pitches which are illegal in the game of slow pitch softball by virtue of their having exceeded a maximum allowable height of twelve feet in traveling from the pitcher's mound to home plate. Infrared, visible, or ultraviolet light is reflected from a ball reaching a height above the permitted maximum to a detector which is incorporated in a unit typically mounted on the backstop at the appropriate height. The light which is reflected may be natural light, or the light may be generated in and propagated from the backstop-mounted unit. In both cases, the impingement of the reflected light on the detector causes that component to output an electrical signal which is amplified and employed to drive a sound generator, thereby providing an audible warning that an illegal pitch has been thrown.

36 Claims, 5 Drawing Sheets

METHOD AND APPARATUS FOR DETECTING ILLEGAL PITCHES

TECHNICAL FIELD OF THE INVENTION

The present invention relates to methods and apparatus for detecting illegal softball pitches.

BACKGROUND OF THE INVENTION

In the game of slow pitch softball, a pitch is illegal if the height it reaches in traveling from the pitcher's mound to home plate exceeds 12 feet.

Heretofore, and at the present time, whether a pitch exceeds this maximum height and is therefore illegal has been judged by the home plate umpire from his position behind the catcher. Particularly as the umpire cannot follow the flight of the ball as a spectator could from one side or the other of the softball diamond from this position, and also as heights are difficult to judge visually with any degree of precision, close calls are very difficult to make and often the subject of great controversy.

SUMMARY OF THE INVENTION

We have now invented, and disclosed herein, novel methods and apparatus in which perhaps erroneous judgment calls by the umpire are eliminated and those pitches which exceed the maximum legal height in the game of slow pitch softball are automatically and accurately identified.

This is done by intercepting ultraviolet, visible, or infrared light reflected from a pitched ball exceeding the maximum permissible height with a detector which is thereupon activated to output an electrical signal. This signal is shaped, if necessary, and amplified; and the amplified signal is employed to drive an audio generator, typically one of the piezoelectric type. Thus, an audible signal is generated if an illegal pitch, i.e., one exceeding the maximum permissible height, is thrown.

The detector and sound generator and the just-discussed circuitry will typically be housed in a casing with U-bolts or other fasteners that allow the unit to be adJusted in height and then securely fixed to an appropriate support. Typically, this support will be one of the screen-supporting stanchions of the backstop conventionally located behind home plate.

The illegal pitch-detecting unit will also typically include a power supply in the form of a rechargeable battery, a switch for turning the system on and off, and a "system on" indicator. In addition, the unit may include a system—typically based on a gas or diode type laser—for generating a beam of visible or invisible radiant energy that can be intercepted and reflected onto the detector by a pitch exceeding the maximum height for a legal pitch. Alternatively, it can be available light that is reflected onto the detector.

OBJECTS OF THE INVENTION

From the foregoing it will be apparent to the reader that one primary and important object of the invention resides in the provision of methods and apparatus for accurately detecting illegal pitches in the game of slow pitch softball.

A second also important, but more specific, object of our invention resides in the provision of apparatus as defined in the preceding object which is durable, relatively inexpensive to produce and install, easy to use, and has low maintenance requirements.

Other important obJects and features and additional advantages of the invention will be apparent to the reader from the foregoing and the appended claims and as the ensuing detailed description of the invention proceeds in conjunction with the accompanying drawing.

DETAILED DESCRIPTION OF THE DRAWING

Figure 1:
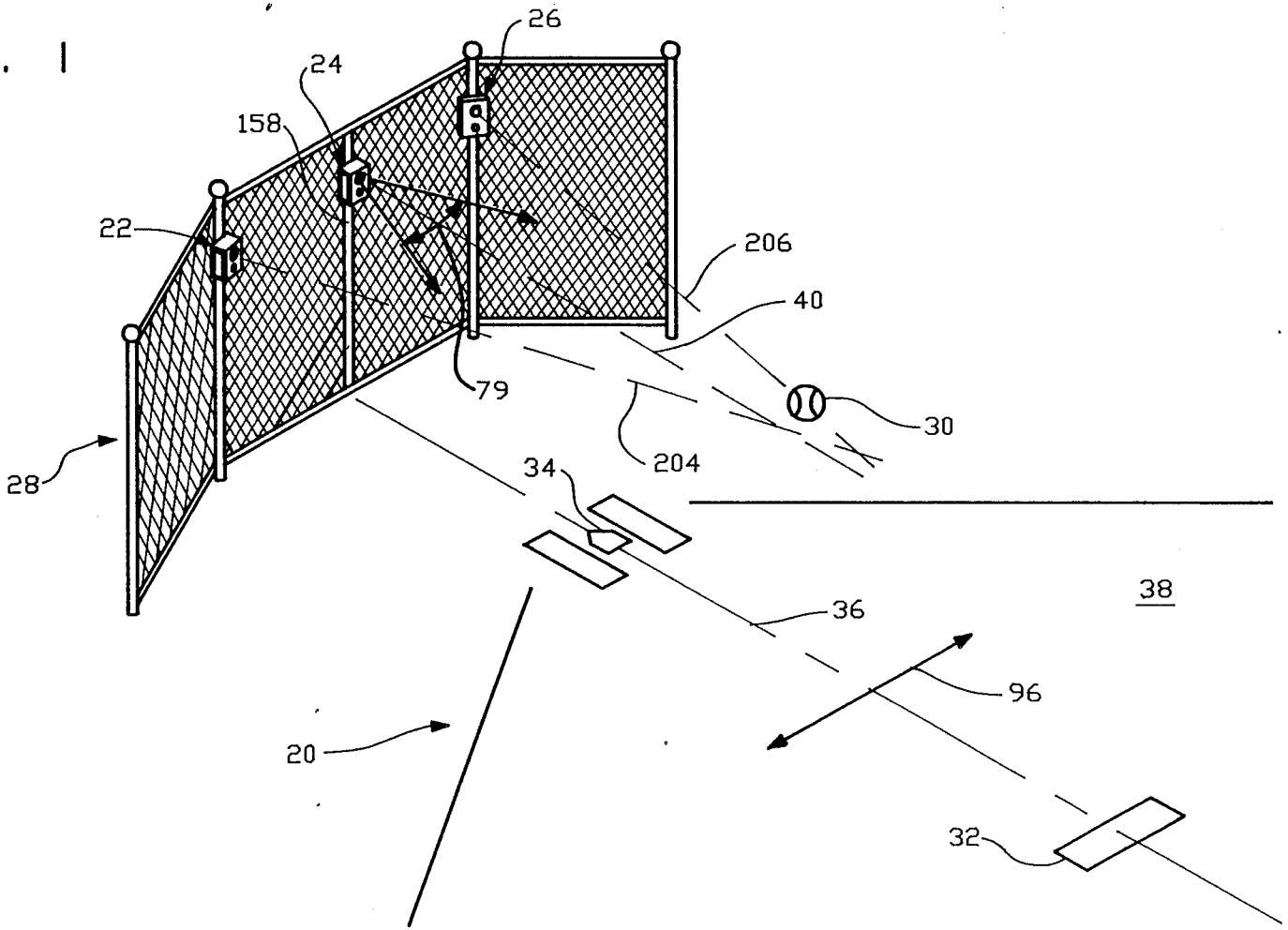
FIG. 1 is a pictorial view of a softball diamond which is equipped to detecting illegal pitches, that apparatus embodying the principles of the present invention.

Referring now to the drawing, FIG. 1 depicts a softball field 20 and three units 22, 24, and 26, each mounted on a backstop 28 and each capable of generating a signal in accord with the principles of the present invention if a softball 30 pitched from pitcher's mound 32 toward home plate 34 reaches a height above the maximum (12 feet) permitted for a legal pitch. In actual practice, it is necessary to employ only one of these three, independently acting units 22, 24, and 26 with a unit such as 24 probably most often being preferred. This unit is aligned along the axis 36 between pitcher's mound 32 and home plate 34 and oriented to project a beam 40 of visible or invisible radiant energy parallel to playing surface 38. Unit 24 is mounted above playing surface 38 at a height so selected that an illegal pitch will intercept and reflect beam 40 back to the illegal pitch-detecting unit.

The three, illegal pitch detecting units 22, 24, and 26 are identical. Accordingly, only unit 24 will be described in detail herein.

Figure 2:
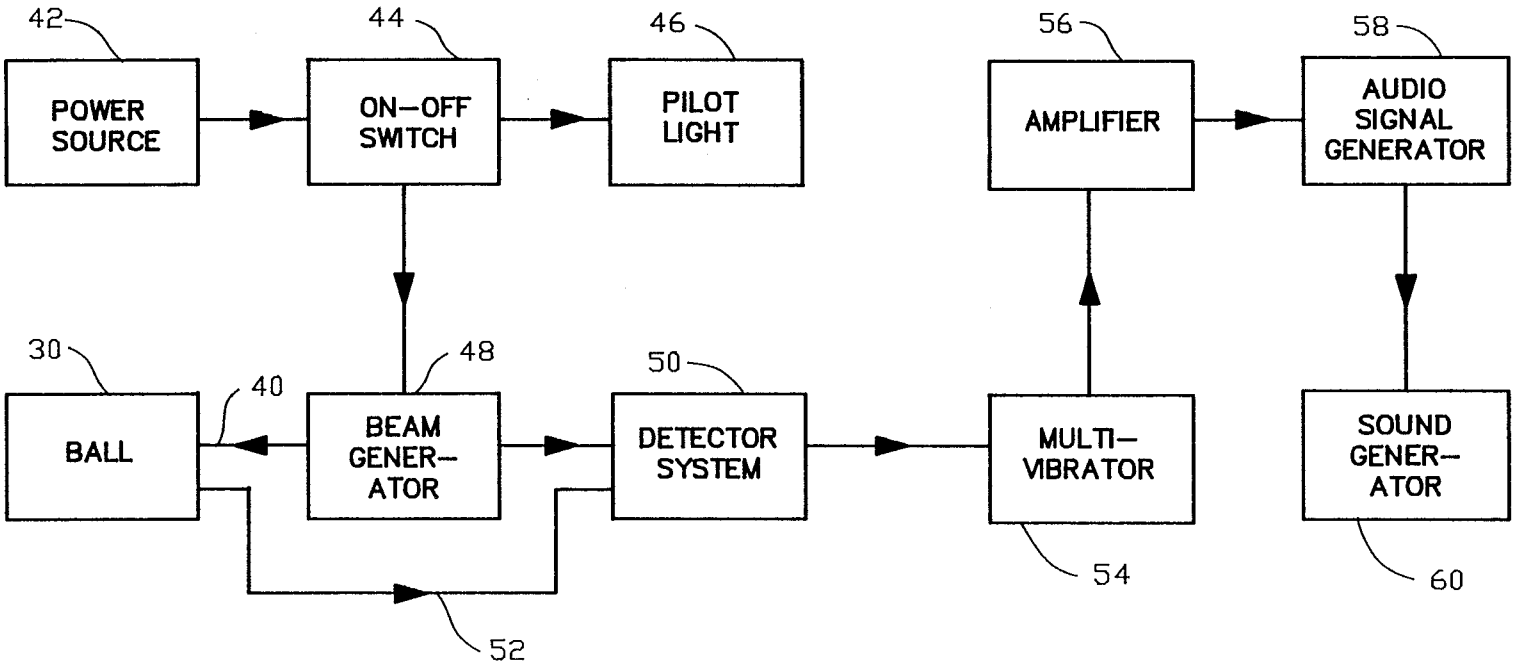
FIG. 2 is a block diagram of the active components of the apparatus for detecting illegal pitches.

Referring now to FIG. 2, the major operating components of illegal pitch detecting unit 24 include a power source 42, preferably a 12-volt rechargeable battery; a switch 44 for turning unit 24 on and off; and a pilot light 46 such as an LED which is illuminated when unit 24 is turned on.

Also included in unit 24 is a system 48 for generating the illegal pitch detecting beam 40 and a companion, detector system 50. The latter is activated to output an electrical signal by energy emitted from source 48 and reflected from an illegally pitched ball 30 to the detector system as indicated by line 52 in FIG. 2.

The signal outputted from detector system 50 is employed in a conventional multivibrator 54 to generate a signal of thereafter usable waveform. The multivibrator output signal is amplified in an also conventional amplifier 56 and then utilized to drive an again conventional audio signal generator 58. The signal outputted from circuit 58 drives a piezoelectric or other sound generator 60. The sound generator is therefore activated and produces an audible signal when a pitched ball 30 exceeds the maximum permissible height for a legal pitch because the ball breaks the beam 40 emitted from generator 48 and, consequentially, reflects return signal 52 to detector system 50, causing the latter to output a sound generator-activating signal in the manner discussed above.

Figure 3:
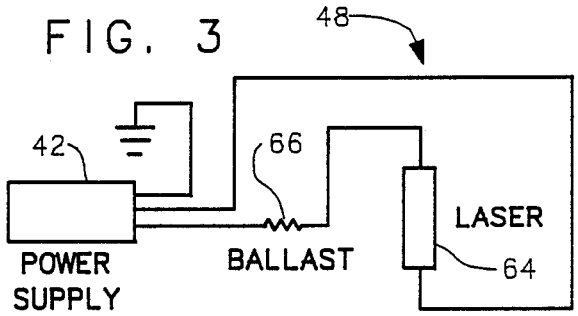
FIG. 3 is a schematic for a beam generator employed in the illegal pitch-detecting apparatus shown in FIG. 2.

Referring now to FIG. 3, the system 48 employed to generate the illegal pitch-detecting beam 40 includes a diode or tube-type laser which propagates a narrow beam of coherent, visible or invisible (infrared or ultraviolet) light and is connected to power supply 42 through a conventional ballast 66 to balance the output voltage and output current from the power supply. To pictorially represent the just-enumerated possibilities, the beam generator is depicted as a helium/neon-type laser 64 in FIG. 3 and as a diode-type laser **64*a* in FIG. 4**.

Figure 5:
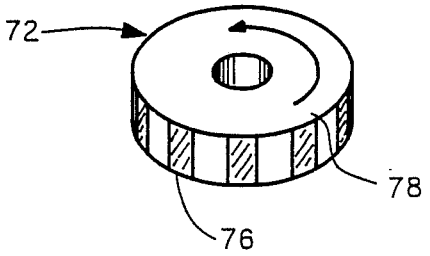
FIG. 5 is a pictorial view of a rotatable mirror array employed in the beam generator of FIG. 4.

The latter Figure, in conjunction with FIG. 5, also depicts in somewhat pictorial form an alternate system 68 for propagating the beam 40 emitted from laser 64 or from laser **64*a*. This system includes an electric motor 70 connected across power supply 42 and a wheel 72 mounted on the output shaft 74 of motor 70 for rotation therewith equally dimensioned mirrors 76 are mounted on the periphery 78 of wheel 72** at equidistantly spaced intervals therearound.

Figure 4:
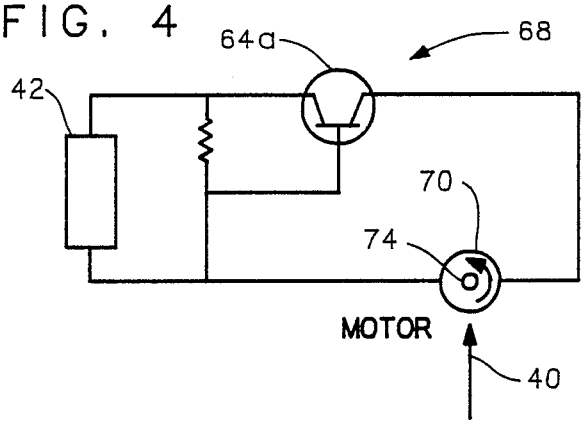
FIG. 4 is a schematic view of a second form of beam generator which can be employed in the apparatus of FIG. 2.

As shown in FIG. 4, the narrow beam 40 of coherent, visible or invisible light emitted from laser 64 or laser **64*a* impinges on the mirrored segments 76 of wheel 72 as the latter is rotated by motor 70. This converts the narrow beam 40 emitted by the laser to a fan-shaped beam identified by reference character 79 in FIG. 1 over a period of time and with a degree of continuity related to the speed of rotation of motor output shaft 74, the dimensions and spacing of mirrors 76, and the diameter of wheel 72. This beam has the advantage that it is capable of detecting a pitch which reaches an illegal height at a point along its path which is displaced to one side or the other from the straight line 36 between pitcher's mound 32 and home plate 34**.

Figure 7:
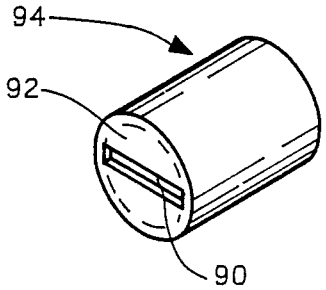
FIG. 7 is a perspective of a detector cover employed in the system of FIG. 6.
Figure 6:
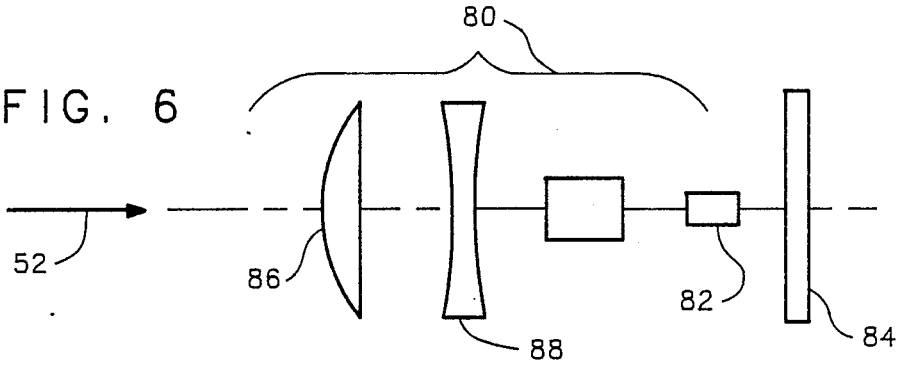
FIG. 6 is a schematic view of a system employed in the apparatus of FIG. 2 to detect energy reflected from an illegally pitched ball and output a corresponding electrical signal.

The detector system 50 is depicted in detail in FIGS. 5–7. It includes an optical system 80, a Photo-Darlington detector 82, and detector output processing circuitry made up of the above-discussed multivibrator 54, amplifier 56, and audio signal generator 58 with the detector 82 and detector circuitry being either printed or mounted on a circuit board 84. Detectors employing a Photo-Darlington transistor are preferred as they are up to 100 times as sensitive to visible and invisible light impinging thereon as a conventional semiconductor-type detector is.

The optical system 80 includes a meniscus lens 86 and a periscopic lens 88 and focuses the beam 52 reflected from an illegally pitched ball 30 on a slit 90 in the closed end 92 of a cylindrical casing 94. Detector 82 is installed in the casing. Therefore, the optical system 80 just described limits that area on either side of axis 36 from which energy can be reflected to detector 82. This minimizes the chances of a false signal being generated by, for example, a large moth or a bird flying in the path of emitted beam 40 and reflecting that beam back to the detector As suggested by arrow 96 in FIG. 1, the optical system just described will typically limit the deviation from axis 36 that will result in reflected energy impinging on detector 82 to a maximum of five feet on either side of axis 36 at a point 22–23 feet in front of pitcher's mound 32.

Figure 8:
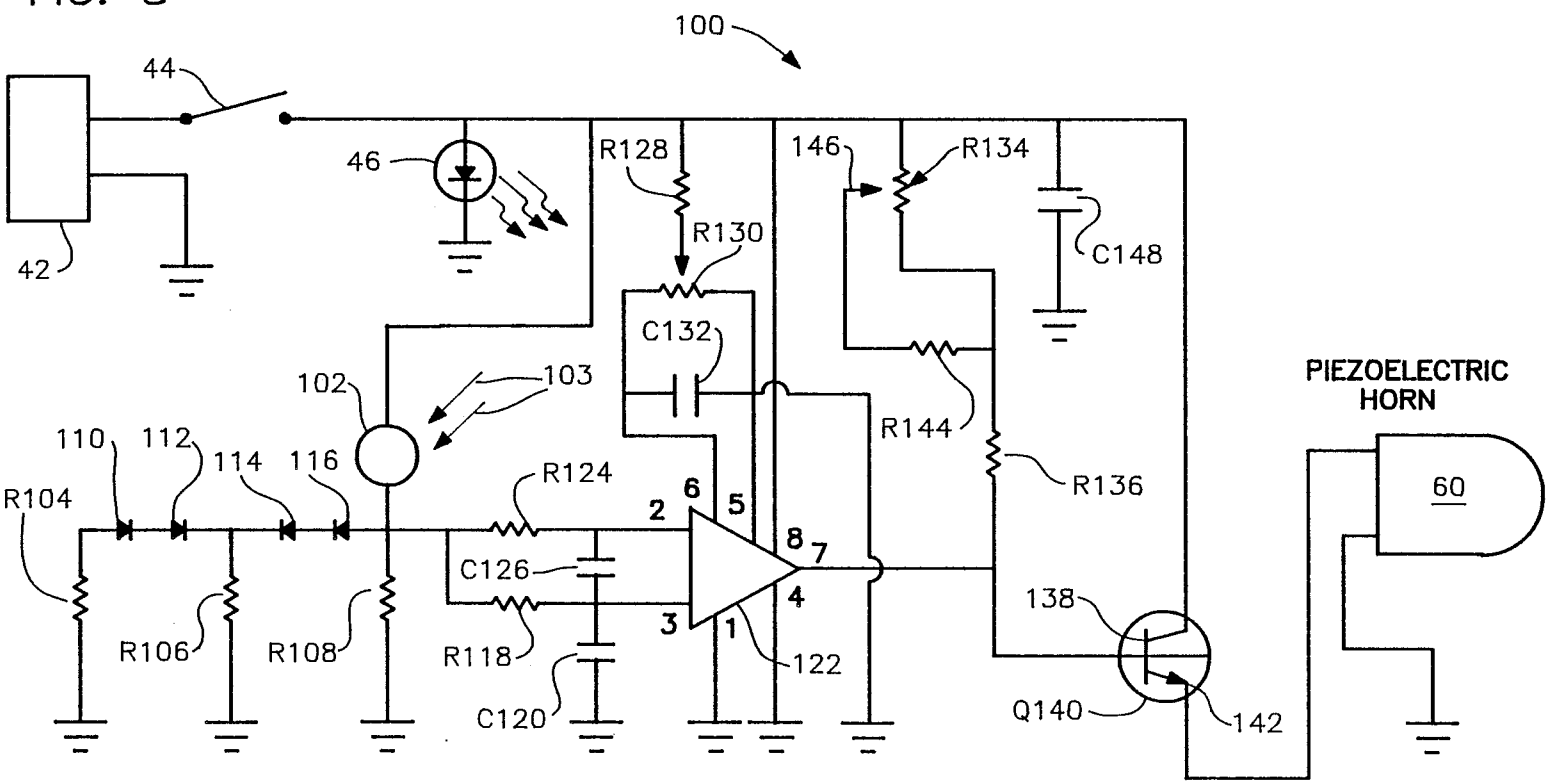
FIG. 8 is a schematic of a second type of system for detecting illegally pitched balls in accord with the principles of the present invention.

It is not required, in the practice of the present invention, that a laser-type beam generator or a Photo-Darlington detector be employed to generate the wanted audible signal when an illegal pitch is thrown. FIG. 8, for example, depicts a system 100, also embodying the principles of the present invention, in which a conventional photocell-type detector 102 is employed to detect ambient light reflected from ball 30 and activate sound generator 60 if a pitch exceeds the twelve foot, legal maximum. To some extent, system 100 and the laser and Photo-Darlington based arrangements described above may employ the same components except that a six- rather than twelve-volt battery will suffice to power the unit. To the extent this is true, those components have been identified by the same reference characters.

Referring now to FIG. 8, light reflected from an illegally pitched ball 30 and impinging upon photocell-type detector 102 as depicted by arrows 103 causes the latter to output an electrical signal. This signal is transmitted to a network including load resistors R104, R106, and R108 plus two opposed pairs of voltage-limiting diodes 110, 112 and 114, 116.

These diode pairs couple either load resistor R104 or resistor R106 into circuit 100, depending upon the polarity of the signal outputted from photocell 102. The photocell output signal, thus dropped by typically about 0.6 volt, is routed through a resistor R118 and a capacitor C120 to the non-inverting terminal 3 of an IC amplifier 122. The circuit consisting of resistor R118 and capacitor 120 removes AC components from the signal inputted to the amplifier.

The photoelectric cell-generated signal is also applied to input terminal 2 of amplifier 122, in this case through a balancing resistor R124 connected in parallel with resistor R118. Resistor R124 ensures that there are equal resistances in the leads to amplifier terminals 2 and 3, thereby minimizing current imbalance in amplifier 122.

A second capacitor C126 is connected in series with capacitor C120 across the leads with resistors R118 and R124. This capacitor eliminates high frequency components from the signals transmitted to amplifier 122, thereby making the amplifier capable of outputting an amplified signal which, after further amplification, can be employed to drive sound generator 60.

Also associated with amplifier 122 are a zero adjust circuit and a hysteresis control circuit. The zero adjust circuit includes a fixed resistor R128 and an adjustable resistor R130 connected in series between power source 42 and each of the two terminals 5 and 6 of amplifier 122. A capacitor C132 connected between adjustable resistor R130 and ground reduces the noise in the zero adjust circuit.

The circuit employed in system 100 to control hysteresis includes an adjustable resistor R134 and a fixed resistor R136 connected in series between power source 42 and the base 138 of an n-p-n transistor Q140. The transistor circuit further amplifies the signal outputted from terminal 7 of amplifier 122 to the level needed to drive sound generator 60, which is coupled to the emitter 142 of transistor Q140. Also incorporated in the circuitry employed to reduce hysteresis in system 100 is a third resistor R144. That resistor is connected in series between resistor R136 and the slider 146 of adjustable resistor R134.

A final component of the system 100 illustrated in FIG. 8 is a capacitor C148. This capacitor functions as a bypass filter.

Figure 9:
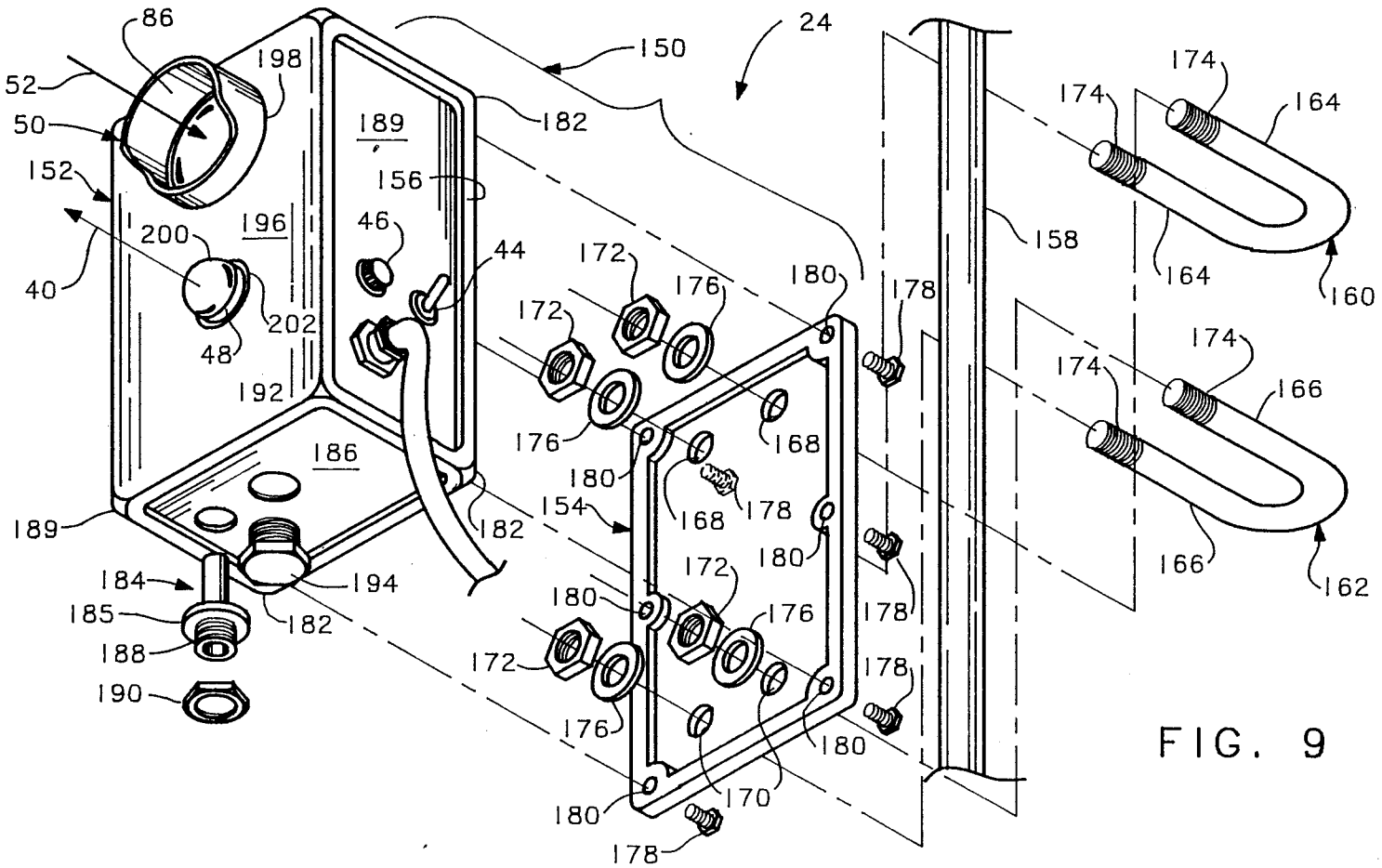
FIG. 9 is an exploded view included primarily to show the details of a casing in which the operating systems of the illegal pitch detecting apparatus are housed.

The physical relationship between the above-described beam generating systems (48 or 68) and reflected beam detecting systems (50 or 100) is shown in FIG. 9.

Referring now to that Figure, the detector system of illegal pitch detecting unit 24, be it of the Photo-Darlington or photoelectric type, is mounted in a casing or housing 150 consisting of a rectangular, system housing box 152 and a cover 154 dimensioned to span and close the open, rear side 156 of the box. The beam generating system, if employed, is also housed in box 152.

Casing 150 is supported at the appropriate height above playing surface 38 and from one of the vertical stanchions 158 of backstop 28 by a pair of vertically spaced apart U-bolts 160 and 162. The legs 164 of upper U-bolt 160 and the legs 166 of lower U-bolt 162 extend through upper apertures 168 in cover 154 and through lower apertures 170 in that component. Nuts 172, threaded onto the ends 174 of the legs 164 and 166 of the upper and lower U-bolts 160 and 162 over washers 176, clamp stanchion 158 between: (1) cover 154 and (2) U-bolts 160 and 162, securely fixing cover 154 to the stanchion at the wanted height above playing surface 38. Thereafter, the boxlike component 152 of casing 150, in which the internal components of unit 24 are housed, is assembled to the stanchion-mounted cover 154 as by cap screws 178. These fasteners extend through apertures 180 in cover 154 into drilled and tapped, blind apertures (not shown) at the four rear corners 182 and intermediate the longer sides 189 of box 152.

Illegal pitch-detecting systems of the type disclosed herein can of course be externally rather than internally powered if an external power source is deemed preferable. A line from the external power source can be routed to the interior of casing 150 for this purpose and/or to power a charger (not shown) for battery 42 through a conventional fitting 184. This fitting is installed in the boxlike component 152 of casing 150 with an integral annular flange 185 seated on the lower wall 186 of that component and a threaded lower end 188 extending to the exterior of the casing. A retainer 190 threaded on this end 188 of the fitting retains it in place.

Also, as is shown in FIG. 9, a drain hole 192 can be provided in the lower wall 186 of casing component 152, if desired. Typically, this opening will be internally threaded so that it can be closed by a fitting 194 threaded into it.

Other components of unit 24, both mounted on the front wall 196 of the boxlike casing component 152, are a lens hood 198 and a clear, optically neutral lens 200. Lens hood 198 protects the optical system 80 of reflected energy detecting system 50 and keeps extraneous light from reaching detector 82. The beam of radiant energy propagated by beam-generating system 48 passes through an aperture 202 in the front wall 196 of casing component 152, and lens 200 keeps moisture and other foreign material from penetrating to the interior of that casing through opening 202.

As suggested above, and as shown in FIG. 1, it is not necessary that the illegal pitch-detecting unit be located directly behind home plate. Instead, as indicated by reference characters 22 and 26, the unit may be located to one side or the other of home plate 34. In that event, the unit will be oriented so that, if artificially generated energy is employed in detecting illegal pitches, the propagated beam of energy (204 or 206) will intersect the line 36 between pitcher's mound 32 and home plate 34 at the location 96 typically 22–23 feet in front of the pitcher's mound.

The alarms generated by the exemplary systems disclosed above are audible in character; and, at the present time, it is believed that audible alarms will be preferred by users of those systems, at least in most circumstances. However, it will be readily apparent to those persons to whom this specification is addressed that visual indicators can readily be substituted for the disclosed audible alarms and that combinations of audible and visual alarms can also be employed with equal ease.

The invention may be embodied in forms other than those disclosed above without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed as the invention is:

1. A method for detecting a softball pitch which is illegal in the game of slow pitch softball because of its reaching a height exceeding the legal maximum as the pitch travels from the pitcher's mound to home place, said method comprising the steps of:

a. providing a supporting means behind home plate;

b. mounting on said supporting means a unit including means for detecting a beam of radiant energy propagated from behind home plate toward the pitcher's mound and reflected from a ball which is traveling from the pitcher's mound toward home plate and is above the height permissible for a legal pitch; and c. employing said unit to generate, upon the detection of said radiant energy thus reflected from an illegally pitched ball by said detecting means, a signal by which at least one of the group consisting of spectators, players, and officials can be made aware that an illegal pitch has been thrown.

2. A method of detecting an illegally pitched softball as defined in claim 1 which includes the step of generating a beam of said radiant energy in said unit and the step of propagating said radiant energy toward the pitcher's mound by directing said beam of radiant energy along an axis which intercepts the path traveled by a pitch thrown from the pitcher's mound toward home plate at a height at which the beam will be intercepted and reflected to the detecting means by an illegally pitched ball, whereby it will be radiant energy generated in said unit that will be reflected onto the detecting means and result in the signal denoting an illegal pitch being generated if a ball of that character is pitched.

3. A method of detecting an illegal pitch as defined in claim 2 wherein it is a fan-shaped beam of energy that is propagated from said unit, whereby said beam of energy can be intercepted by illegally pitched balls that exceed the maximum permissible height at a point where they lie to one side or the other of a straight line between the pitcher's mound and home plate.

4. A method of detecting an illegal pitch as defined in claim 2 which includes the step of aiming said beam so that it parallels the playing surface at the maximum legal height which the pitch may reach.

5. A method of detecting an illegal pitch as defined in claim 1 in which said unit is located on an extension of a straight line from the pitcher's mound to home plate.

6. A method of detecting an illegal pitch as defined in claim 1 in which said unit is located to one side of a straight line between the pitcher's mound and home plate.

7. A method of detecting an illegal pitch as defined in claim 6 which includes the step of generating a beam of said radiant energy in said unit and the step of propagating said beam of radiant energy toward said pitcher's mound by directing said beam of radiant energy along an axis which intercepts the path traveled by a ball pitched from the pitcher's mound toward home plate at a height at which the beam will be intercepted and reflected to the detector by an illegally pitched ball, whereby it will be radiant energy generated in said unit that will be reflected onto the detecting means and result in the signal denoting an illegal pitch being generated if a ball of that character is pitched, said method further including the step of so aiming said beam of radiant energy that it crosses said straight line at a selected point between the pitcher's mound and home plate.

8. A method of detecting an illegal pitch as defined in claim 1 in which it is an audible signal that is generated when an illegal pitch is detected.

9. A method for detecting a softball pitch which is illegal in the game of slow pitch softball because of its reaching a height exceeding the legal maximum as the pitch travels from the pitcher's mound to home plate, said method comprising the steps of:

a. providing a supporting means behind home plate;
b. mounting on said supporting means a unit including means for detecting a beam of ambient light reflected from a ball which is traveling from the pitcher's mound toward home plate and is above the height permissible for a legal pitch; and
c. employing said unit to generate, upon the detection of ambient light thus reflected from an illegally pitched ball by said detecting means, a signal by which at least one of the group consisting of spectators, players, and officials can be made aware that an illegal pitch has been thrown.

10. A method of detecting an illegal pitch as defined in claim 9 in which said unit is located on an extension of a straight line leading from the pitcher's mound to home plate.

11. A method of detecting an illegal pitch as defined in claim 9 in which said unit is located to one side of a straight line from the pitcher's mound to home plate.

12. A method of detecting an illegal pitch as defined in claim 9 in which it is an audible signal that is generated when an illegal pitch is detected.

13. The combination of a playing surface, a pitcher's mound and a home plate on said playing surface, and means for detecting those pitches thrown from the pitcher's mound toward home plate that are illegal by virtue of their exceeding a maximum permissible height as they travel between the pitcher's mound and home plate, said means for detecting illegal pitches comprising:

a. means for propagating a beam of radiant energy along a path above and paralleling a line between said home plate and said pitcher's mound;
b. detector means providing an electrical output upon contact therewith of radiant energy propagated from the means defined in paragraph a and reflected from a ball pitched from the pitcher's mound toward home plate; and
b. signaling means electrically coupled to said detector means and activated by the appearance of said detector means output.

14. A combination as defined in claim 13 which also has:

a. a support behind the home plate;
b. a casing housing said detector means and said signaling means; and
c. means for securing said casing to said support at a selected height above said playing surface.

15. A combination as defined in claim 14:

a. which includes a backstop;
b. wherein said support is a vertically oriented stanchion; and
c. wherein the combination also includes means for securing said casing to said support at a selected height above said playing surface.

16. A combination as defined in claim 14:

a. which includes a backstop; and wherein:
b. said support is a vertically oriented stanchion;
c. said casing has a cover and a boxlike, component housing member detachably connectable to said cover; and
d. the means for securing the casing to the support comprises at least one fastener means for clamping said cover to said stanchion.

17. A combination as defined in claim 14 which also has a rechargeable power source in said casing.

18. A combination as defined in claim 13 which includes means for imparting a diverging, fan-shaped configuration to said beam of radiant energy so that said beam will span the line between said home plate and said pitcher's mound and thereby be interceptable by balls which exceed said maximum permissible height at locations to one side or the other of said line.

19. A combination as defined in claim 13 in which the means for propagating said beam of radiant energy includes a laser.

20. A combination as defined in claim 13 in which the detector means includes a Photo-Darlington transistor.

21. A combination as defined in claim 13 in which the signaling means is a piezoelectric-type sound generator.

22. The combination of a playing surface, a pitcher's mound and a home plate on said playing surface, and means for detecting those pitches thrown from the pitcher's mound toward home plate that are illegal by virtue of their exceeding a maximum permissible height as they travel between the pitcher's mound and home plate, said means for detecting illegal pitches comprising:

a. detector means for providing an electrical output upon contact therewith of ambient light reflected from a ball pitched from the pitcher's mound toward home plate; and
b. signaling means electrically coupled to said detector means and activated by the appearance of said detector means output.

23. A combination as defined in claim 22 in which said detector means is a photocell which is designed to be triggered and produce an output as aforesaid by that ambient light illegally pitched ball onto the detector means.

24. A combination as defined in claim 22 which also has:

a. a support behind the home plate;
b. a casing housing said detector means and said signaling means; and
c. means for securing said casing to said support at a selected height above said playing surface.

25. A combination as defined in claim 24:

a. which includes a backstop;
b. wherein said support is a vertically oriented stanchion; and
c. wherein the combination also includes means for securing said casing to said stanchion at the selected height above said playing surface.

26. A combination as defined in claim 24:

a. which includes a backstop; and wherein:
b. said support is a vertically oriented stanchion;
c. said casing has a cover and a boxlike, component housing member detachably connectable to said cover; and
d. the means for securing the casing to the vertically oriented stanchion comprises at least one fastener means for clamping said cover to said stanchion.

27. A combination as defined in claim 24 which also has a rechargeable power source in said casing.

28. A combination as defined in claim 24 in which the signaling means is a piezoelectric-type sound generator.

29. A unit which can be mounted on a support and is designed to detect a softball pitch that is illegal by virtue of its reaching a height exceeding the permissible maximum in the game of slow pitch softball as the softball travels from the pitcher's mound of a softball field toward home plate, said unit comprising:

a. a casing;
b. means for attaching said casing to a support therefor at a selected height;
c. means for propagating a beam of radiant energy along a path parallel to and above the surface of the softball field;
d. detector means for providing an electrical output upon being contacted by propagated radiant energy reflected from a ball pitched from the pitcher's mound toward home plate and reaching a height above the permissible maximum; and
e. signaling means electrically coupled to said detector means and activated by the appearance of the electrical output from said detector means.

30. A device as defined in claim 29 which also includes a rechargeable power supply.

31. A unit as defined in claim 29 which includes means for imparting a diverging, fan-shaped configuration to said propagated beam of radiant energy.

32. A unit as defined in claim 29 in which the means for propagating said beam of radiant energy includes a laser.

33. A unit as defined in claim 29 in which the detector means includes a Photo-Darlington transistor.

34. A unit which can be mounted on a support and is designed to detect a softball pitch that is illegal by virtue of its reaching a height exceeding the permissible maximum in the game of slow pitch softball as the softball travels from the pitcher's mound toward home plate, said unit comprising:

a. a casing;
b. means for attaching said casing to a support therefor at a selected height;
c. detector means for providing an electrical output upon being contacted by ambient light energy reflected from a ball pitched from the pitcher's mound toward home plate and reaching a height above the permissible maximum; and
d. signaling means electrically coupled to said detector means and activated by the appearance of the electrical output from said detector means.

35. A unit as defined in claim 34 in which said detector means is a photocell which is designed to be triggered to produce an output as aforesaid by that ambient light reflected from an illegally pitched ball onto the detector means.

36. A device as defined in claim 34 which also includes a rechargeable power supply.

* * * * *

UNITED STATES PATENT AND TRADEMARK OFFICE

CERTIFICATE OF CORRECTION

PATENT NO. : 4,972,171

DATED : November 20, 1990

INVENTOR(S) : Mark P. Johnson et al

It is certified that error appears in the above-indentified patent and that said Letters Patent is hereby corrected as shown below:

Column 6, line 37, change "place" to --plate--.

Column 9, line 5, after "light" insert --reflected from an--.

Signed and Sealed this

Twenty-eighth Day of June, 1994

*Attest:*

*Attesting Officer*

BRUCE LEHMAN

*Commissioner of Patents and Trademarks*